US005332213A

United States Patent [19]

Klose, deceased

[11] Patent Number: 5,332,213

[45] Date of Patent: Jul. 26, 1994

[54] BALL-GAME RACKET, PARTICULARLY A TENNIS RACKET

[75] Inventor: Volker Klose, deceased, late of Straubing, Fed. Rep. of Germany, by Gabriele Klose, heir

[73] Assignee: Franz Volkl GmbH & Co. Ski Und Tennis Sport-Artkihelfabrik KG., Fed. Rep. of Germany

[21] Appl. No.: 10,413

[22] Filed: Jan. 28, 1993

[30] Foreign Application Priority Data

Jan. 29, 1992 [DE] Fed. Rep. of Germany ..... 4202476
Feb. 8, 1992 [DE] Fed. Rep. of Germany ..... 4203682
Sep. 8, 1992 [DE] Fed. Rep. of Germany ..... 4229898

[51] Int. Cl.[5] ..... A63B 49/14
[52] U.S. Cl. ..... 273/73 D
[58] Field of Search ..... 273/73 R, 73 C, 73 D

[56] References Cited

U.S. PATENT DOCUMENTS 1,665,598 4/1928 May ..... 273/73 D
4,309,033 1/1982 Parker, Jr. et al. ..... 273/73 D
4,333,649 6/1982 Vaughn et al. ..... 273/73 D
4,741,531 5/1988 Szedressy ..... 273/73 D
4,949,968 8/1990 Korte-Jungermann ..... 273/73 D X
5,014,987 5/1991 Soong ..... 273/73 D X

FOREIGN PATENT DOCUMENTS 3506025 8/1986 Fed. Rep. of Germany ... 273/73 D
2598323 11/1987 France ..... 273/73 D

*Primary Examiner*—William E. Stoll
*Attorney, Agent, or Firm*—Rosenman & Colin

[57] ABSTRACT

A ball-game racket, particularly a tennis racket, including a hollow, outwardly closed racket body that forms a racket handle and a racket frame including a racket head, the racket frame being provided with stringing formed of intersecting string lengths on the racket head and defining a stringing plane, at least part of the string lengths having on the inside of the frame, at least in an axial direction perpendicular to the stringing plane, a mobility greater than the corresponding mobility of the outer side of the racket frame.

13 Claims, 5 Drawing Sheets

BALL-GAME RACKET, PARTICULARLY A TENNIS RACKET

The present invention relates to a ball-game racket and more particularly to a tennis racket.

Ball-game rackets, such as tennis rackets, of many types are known. In particular, it is also known to provide means for fastening string lengths to the racket head for forming the stringing on the racket head, the string lengths being passed through the part of the frame forming the head of the racket with the use of sleeves of elastic material. The use of the sleeves provides improved stringing as well as a damping effect.

In the case of tennis rackets having a hollow frame, it is known (U.S. Pat. No. 5,014,987) to effect the attachment of the strings in a manner such that the length of string is so fixed on the outside of the frame at each place of attachment of a string so that movement of the length of string with respect to the frame is practically impossible, whereas on the inner side of the frame increased mobility of the specific length of string both in an axial direction of the plane of stringing and in an axial direction perpendicular to the plane of stringing is established. This is accomplished in a manner such that the string lengths are guided on the inner side of the frame through openings, the cross section of which is substantially greater than the cross section of the lengths of string. By fixing the lengths of string on the outside of the frame, a well-defined position of the stringing with respect to the frame as well as with respect to the handle of the racket is obtained, as is necessary for the stability and performance of the racket. Due to the increased mobility on the inside of the frame, the "feel" of the racket during use is improved. This improvement also leads to improved damping and to the avoidance of vibrations in the stringing which are uncomfortable. In particular, however, due to its mobility, the effective playing surface of the tennis racket is substantially increased, so that with a racket of normal size the properties of a large-head racket can be obtained, or substantially obtained.

It is the object of the invention to provide a ball-game racket, particularly a tennis racket, which, while retaining the aforementioned advantages and the possibility of economical manufacture, also satisfies the quality demands which are placed on a tennis racket.

The present invention provides a ball-game racket particularly a tennis racket, said racket comprising a hollow, outwardly closed racket body which forms a racket handle and a racket frame including a racket head, a stringing formed of intersecting string lengths on the racket head and defining a stringing plane, openings in said frame, said openings being provided with sleeves which close the frame tightly off from the outside at the openings, said sleeves having sleeve openings through which the string lengths are passed from the inside of the frame to the outside of the frame and vice versa for obtaining a string attachment holding the stringing on the frame, and for at least a part of the string lengths, said string attachment is such that said string lengths, have, on the inside of the frame, at least in an axial direction perpendicular to the stringing plane, a mobility which is substantially greater than a corresponding mobility of the outer side of the racket frame, and for said string attachment, each of the corresponding sleeves having a sleeve opening which widens in cross section towards the inside of the racket frame and has, on the inside of the racket frame, at least in an axial direction perpendicular to the stringing plane, a size which is greater than the cross section of the string lengths.

In the ball-game racket of the invention, the mobility of the string lengths on the inside of the frame in the axial direction perpendicular to the plane of the stringing is established in a manner such that the corresponding sleeve has a sleeve opening the dimension or cross section of which on the inside of the frame is greater than the cross section of the corresponding length of string. On the outside of the frame, on the other hand, the length of string in question is fixed in such a manner that there is no possibility of movement of the length of string relative to the frame, or in any event only a small possibility of movement which is substantially less than the possibility of movement on the inside of the frame.

In this connection the sleeve is seated in openings or holes which are provided on the frame part on the outside of the frame and on the inside of the frame, respectively. The sleeve closes the part of the frame forming the racket head at these openings so that penetration of moisture, dirt or other foreign particles into the hollow space is impossible.

The sleeve is preferably so developed that the cross section of the sleeve widens in trumpet or funnel shape towards the inside of the frame.

In a preferred embodiment, the sleeve opening is of oval cross section, in such a manner that the possibility of movement is present only in one axial direction, namely in the axial direction perpendicular to the plane of the stringing.

By suitable distribution of such string attachments which permit mobility of the string lengths on the inside of the frame and of such string attachments which permit only a limited mobility or no mobility, the properties of the tennis racket or stringing can be optimally adjusted.

The invention furthermore provides the possibility that, at least in the case of a part of the sleeves, the sleeve openings in the region thereof not taken up by the corresponding string lengths are occupied, at least in part, by a damping material of permanent elasticity.

The invention will be described in further detail below with reference to an embodiment shown in the drawings, in which.

Figure 1:
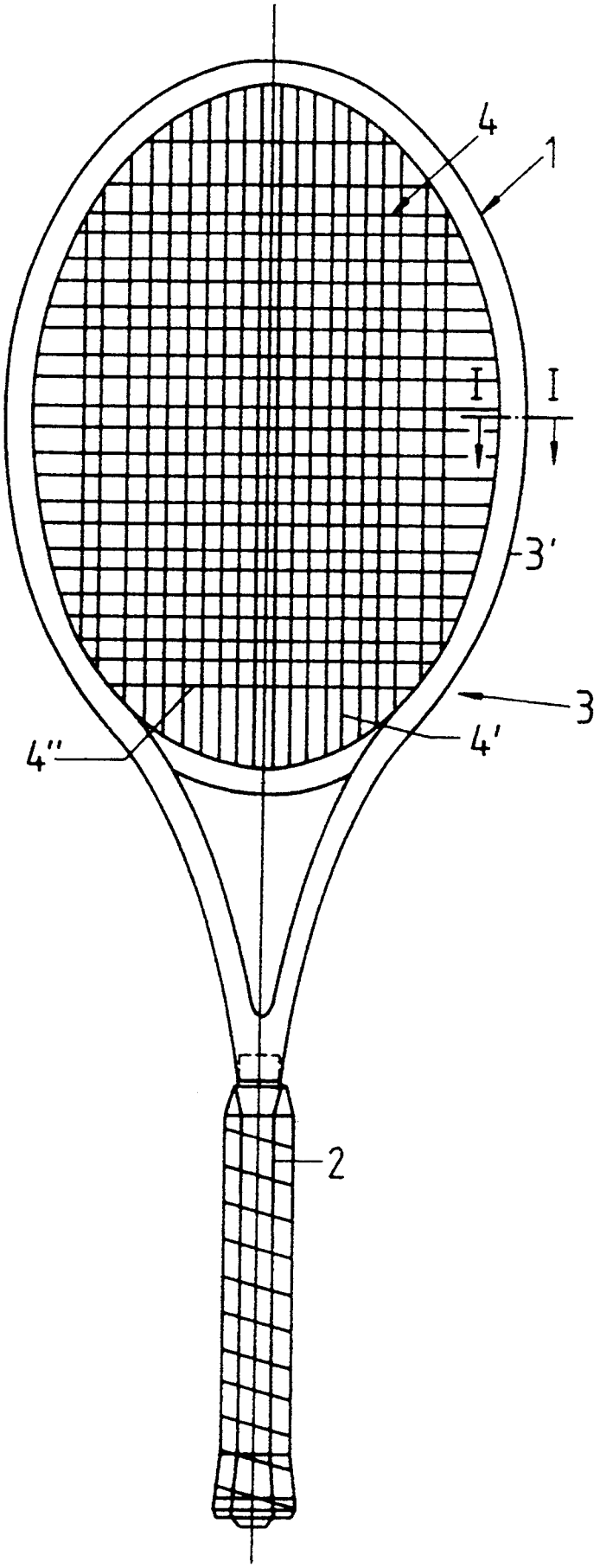
FIG. 1 shows a ball-game racket in the form of a tennis racket, seen in plan view.

The tennis racket shown in the FIGURES consists essentially of a frame 3 forming a racket head 1 and a racket handle 2 and of the stringing 4 provided on the racket head 1.

Both in the region of the racket head 1 and of the frame part 3' forming this racket head and in the region of the racket handle 2, the frame 3 is developed as an outwardly closed hollow body or hollow frame of a fiber-reinforced plastic material.

The stringing 4, in known manner, has intersecting string lengths 4' and 4'', the string lengths 4' extending parallel to the longitudinal axis of the racket head 1 and the side lengths 4" extending perpendicular thereto. The stringing 4 by these side lengths 4' and 4" defines a stringing plane BE and is held on the frame member 3' in the manner that the string lengths 4' and 4" forming the stringing 4 are passed in each case at one region through the frame member 3' from the frame inner side facing the center of the tennis racket head 1 or stringing to the frame outer side, and at another region again through the frame member 3' from the frame outer side to the frame inner side. At each of these passage places a sleeve 9 which surrounds the string lengths is arranged in the frame member 3'.

The frame member 3' or the wall of this frame member has a hole 10 on the outside of the frame and a hole 11 on the inside of the frame. The corresponding sleeve 9, made of an elastic plastic material, is so inserted in these holes that it rests, via a web-like widened section 9', against the outside of the frame and extends, via a sleeve-like section 9" through the holes 10 and 11 which are arranged coaxially with each other and the axes of which lie in the stringing plane BE. The sleeve-like section 9" is adapted in its outer or circumferential surface with respect to cross-sectional shape and size in such a manner to the cross-sectional shape and size of the holes 10 and 11 that the section 9" of the sleeve 9 is seated in fitted manner in these holes 10 and 11. Thus, the frame member 3' is completely closed on the outside by the corresponding sleeve 9 in the region of the corresponding holes 10 and 11 and also protected against the penetration of moisture, dirt or other foreign particles.

In the embodiment shown, the two holes 10 and 11 have the same cross section, which is greater than the cross section of the stringing 4 and of the string lengths 4' and 4" forming the stringing.

For simpler installation, the section 9' may be developed in the form of a ledge and a large number of sections 9" may be provided on said section, each section 9" being arranged in the above-described manner in the holes 10 and 11. Each sleeve-shaped section 9" has an opening 12 through which the corresponding string length 4' or 4" is passed for the fastening of the string, the partial length of the stringing 4 which extends on the outside of the frame member 3' from one place of passage to the next place of passage resting on the section 9'. The opening 12 of the sleeve 9 has a cross section which widens in trumpet or cone shape towards the end of section 9" facing away from the section 9', i.e. from the outside of the frame to the inside of the frame, in such a manner that the corresponding string length is surrounded substantially in fitted manner by the sleeve 9 on the outside of the frame, and the stringing 4 is therefore so fixed in the region of the hole 10 that substantially no movement of the stringing 4 is possible, neither in an axial direction A perpendicular to the stringing plane BE nor in an axial direction parallel to the stringing plane BE. Starting from the partial length of the section 9" received by the hole 10, the cross section of the opening 12 increases in the cross-sectional axis perpendicular to the plane of stringing such that it is greater on the inside of the frame than the cross section of the string lengths. In this way, movement of the stringing 4 in the axial direction A is possible on the inside of the frame due to free movement of the string 4 in the opening 12.

The opening 12 has an oval cross section, so that substantial free movement of the stringing 4 is possible only in the axial direction A, while in an axial direction which is perpendicular to the axial direction A and also perpendicular to the lengthwise direction of the corresponding string length, contact of the string length 4' or 4" with the sleeve 9 is at least substantially prevented.

Figure 2:
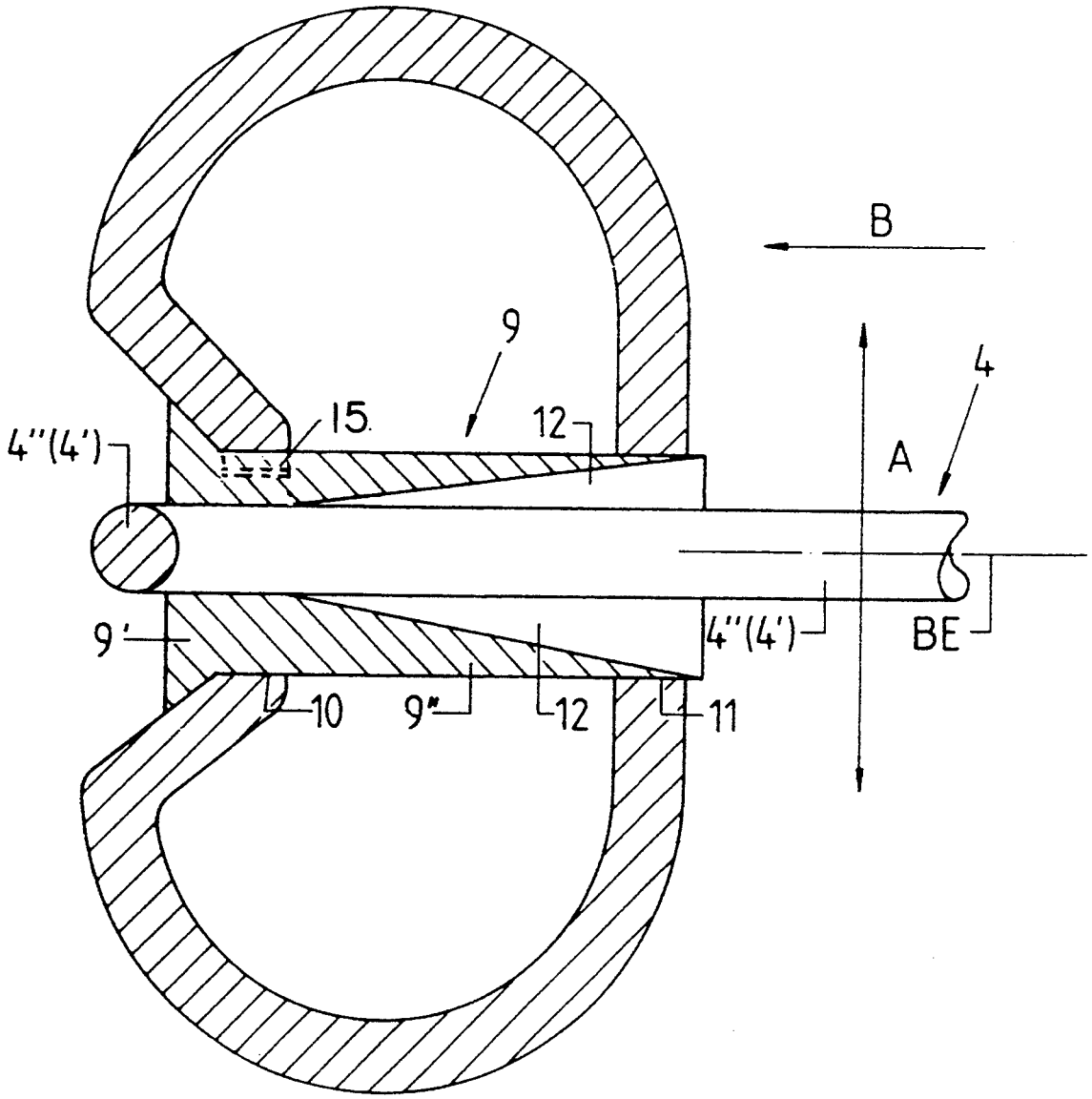
FIG. 2 is a section on a larger scale along the line I—I of FIG. 1.

Due to the possibility of movement of the stringing 4 in the direction of the axis A on the inner side 4 of the frame, an increase in the effective playing surface is, among other things, obtained, in such a manner that the tennis racket, having a normal size racket head 1, has the properties, or substantially the properties, of a large-head racket. By the use of an opening 12 with an oval cross section, the larger cross-sectional axis of which lies in the axial direction A, it is assured that movement of the corresponding string length 4' in an axial direction perpendicular to the plane of the drawing of FIG. 2 is not possible, so that, among other things, the desired direction of the stringing 4, with which the string lengths 4' and 4" extend linearly and intersect each other at a predetermined angle, i.e. at an angle of 90°, will be retained even after lengthy use of the racket.

By allowing the possibility of movement of the stringing 4 in the direction of the axis A, there is furthermore obtained a substantial improvement in the ease of use of the racket such that, even with a very rigid frame 3, an improved damping is obtained and, in addition, vibration of the stringing 4, which may be uncomfortable, is avoided.

Figure 3:
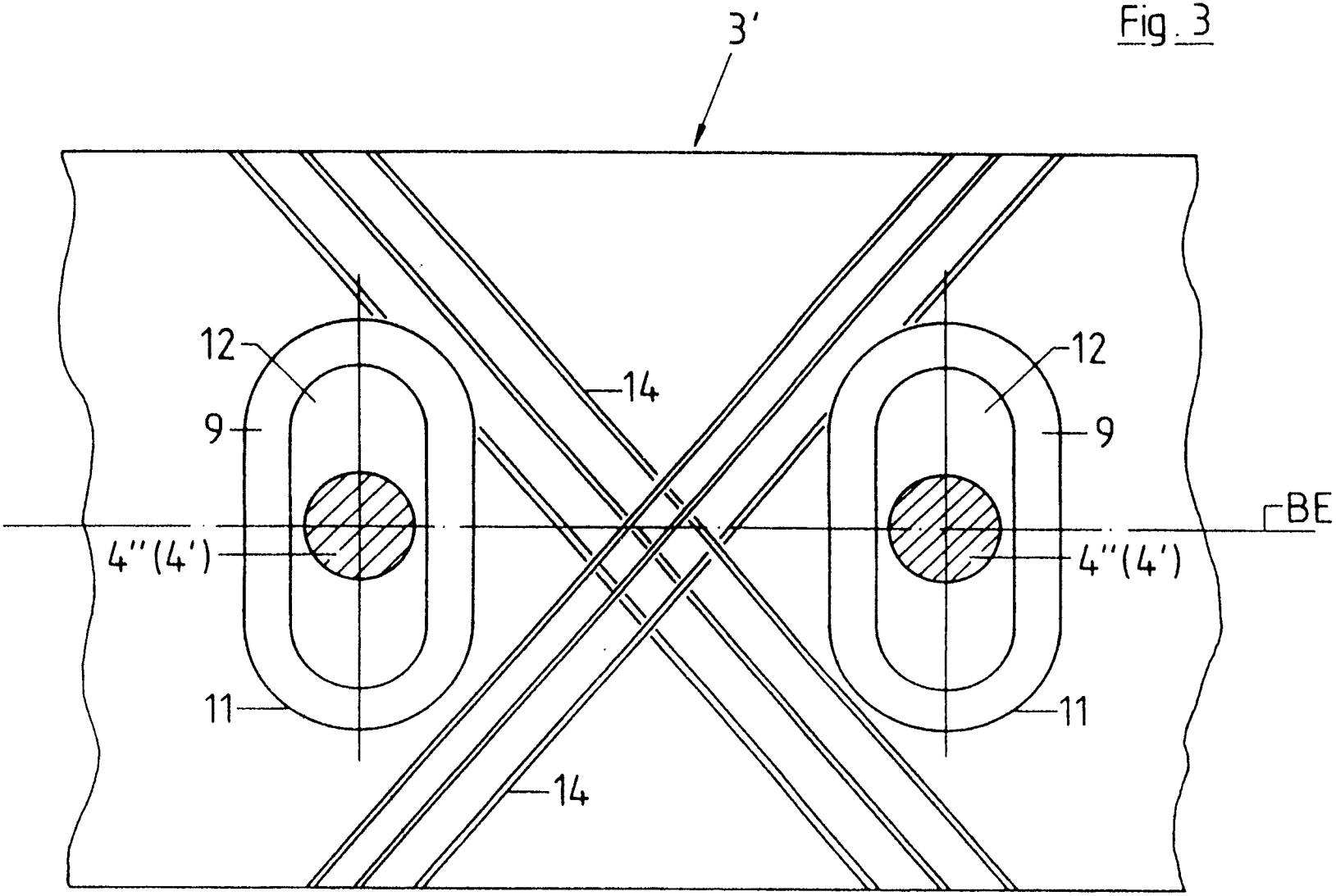
FIG. 3 is a plan view of the inside of the frame seen in a direction corresponding to the arrow B in FIG. 2.

In the embodiment shown in FIG. 3, the openings 11 and 10 have an oval cross section the longer cross-sectional axis of which extends in the axial direction A. The outside cross section of the sleeve 9 corresponds to the cross section of the openings 10 and 11. This embodiment has the advantage that, particularly on the inside of the frame between two adjacent openings 11, the widest possible region remains in which the wall of the frame part 3' is not interrupted. A large part of the fibers 14 of the fiber-reinforced plastic material which intersect oblique to the plane of the stringing BE on the frame outer side and on the frame inner side are therefore not interrupted by the openings 10 and 11. Other fibers 14, which are interrupted by these openings, overlap with sufficient length so that, as a whole, a high degree of stability is obtained at the more critical frame inner side where the distance apart of the openings 11 is smaller than the distance apart of the openings 10 on the outer side.

Figure 4:
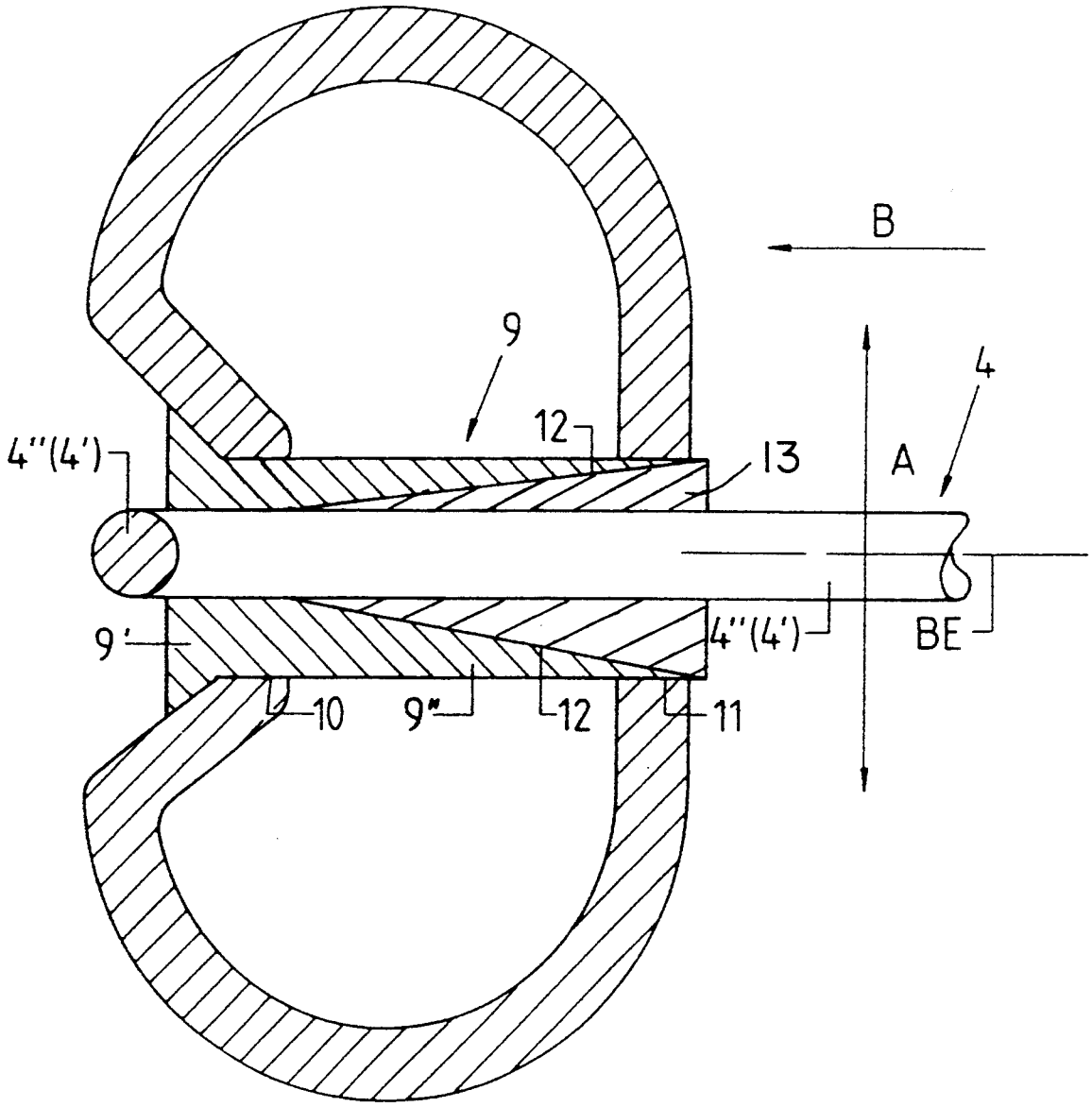
FIG. 4 is a showing similar to FIG. 2 in the case of a modified embodiment.

In the embodiment shown in FIG. 4, a damping material 13 is introduced in the opening 12 of the sleeve 9 which surrounds the corresponding string length 4' or 4" in the region of both holes 10 and 11, said material completely filling the corresponding opening 12 in the part thereof not taken up by the string length 4' or 4" in the embodiment shown. The material 13 is a material of permanent elasticity which absorbs energy of movement upon deformation, i.e. converts it into heat and thereby exerts a damping effect. After the insertion of the sleeves 9 and after the stringing of the racket, the material 13 is introduced into the openings 12. By the tight closing, in particular, of the holes 10 and 11 by the sleeves 9, it is assured that the material 13 enters only into the openings 12 and not into the inside of the hollow frame 3 or hollow frame member 3'.

As a result of the damping material 13, in combination with the possibility of movement of the stringing 4 in the axial direction A, a substantial improvement in the "feel" of the racket during use is obtained, namely, among other things, because of substantially improved damping even with a very rigid frame 3. Furthermore, vibrations of the stringing 4 are avoided, which, among other things, adversely affect the desired "feel" of the racket.

In the embodiment of FIG. 4, in the same way as in the embodiment shown in FIG. 2, the end of the sleeve 9 lying away from the section 9' protrudes slightly beyond the inside of the frame member 3', the opening 12 being filled completely with the material 13, i.e. in particular also in the region of the hole 1. In this way, the result is obtained that the material 13 has a damping effect, in particular, also at the place where the greatest movement of the stringing 4 is possible in the region of the sleeve 9. Furthermore, due to the development described, the result is also obtained that at the place where the greatest forces are exerted on the material 13 upon the damping, there is direct support for the material 13 on the frame member 3' via the sleeve 9, without subjecting the sleeve 9 or section 9'' substantially to bending moments.

Figure 5:
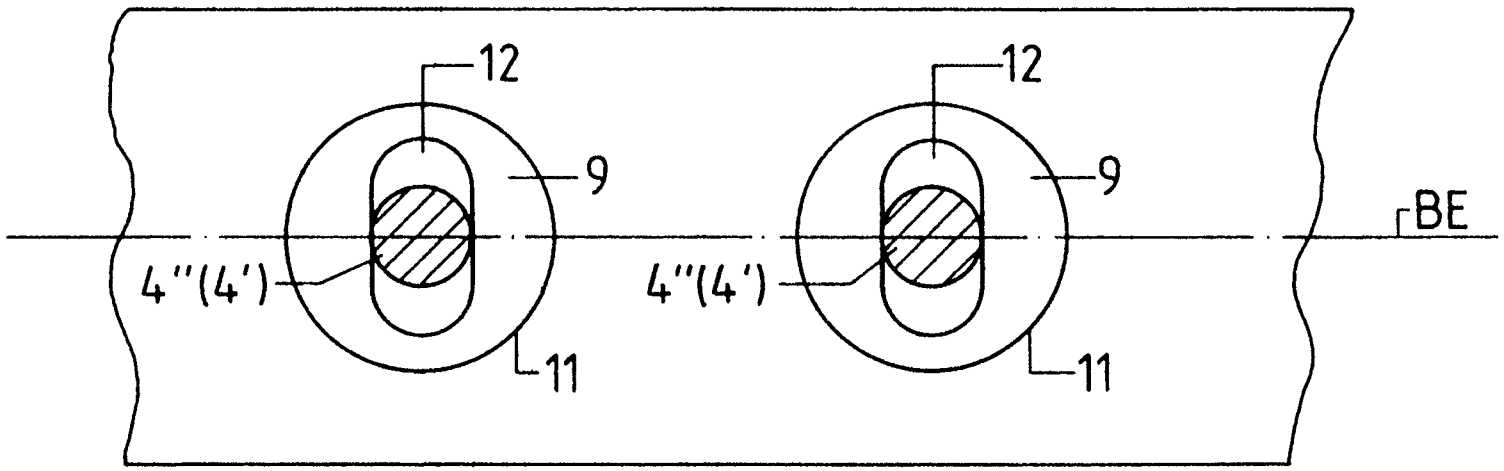
FIG. 5 is a showing similar to FIG. 3 of a further embodiment of the invention.

FIG. 5, in a view similar to FIG. 3, shows another embodiment in which each of the sleeves 7 has an outer cross section of the shape of a circular cylinder and in which, accordingly, also the openings 10 and 11 in the frame member 3' have the shape of a circular cylinder. Also in this embodiment, the hole 12 of each sleeve again has a cross section which has been described above, which widens in trumpet or conical shape in the axis of the cross section perpendicular to the stringing plane BE, so that movement of the stringing 4 in the axial direction A is possible, namely by free movement of the stringing in the hole 12, while movement in the stringing plane BE and perpendicular to the corresponding string length 4' or 4'' is not possible, or at least not substantially possible.

The invention has been described above on basis of examples. It is self-evident that changes as well as modifications are possible without thereby going beyond the scope of the basic inventive concept. Thus, it is possible, for instance, to provide the opening 10 in the embodiments shown in FIGS. 2 and 4 with a smaller diameter than the opening 11. In such case, the sleeve-like section 9'' is then provided, at the region of passage to the section 9', with a circumferential groove 15 into which the edge of the opening 10 extends. Independently of this, the sleeves 9 are preferably part of a sleeve ledge. The embodiment of FIG. 5 has the advantage that the circular cylindrical openings 10 and 11 can be very easily produced, and that in spite of that, deflection of the stringing 4 is possible only in the direction A.

We claim:

1. A ball-game racket, particularly a tennis racket, said racket comprising:

a hollow, outwardly closed racket body which forms a racket handle and a racket frame including a racket head, a stringing formed of intersecting string lengths on the racket head and defining a stringing plane, openings in said frame, said openings being provided with sleeves which close the frame tightly off from the outside at the openings, said sleeves having sleeve openings through which the string lengths are passed from the inside of the frame to the outside of the frame and vice versa for obtaining a string attachment holding the stringing on the frame, and for at least a part of the string lengths, said string attachment is such that said string lengths, have, on the inside of the frame, at least in an axial direction perpendicular to the stringing plane, a mobility which is substantially greater than a corresponding mobility of the outer side of the racket frame, and for said string attachment, each of the corresponding sleeves having a sleeve opening which widens in cross section towards the inside of the racket frame and has, on the inside of the racket frame, at least in an axial direction perpendicular to the stringing plane a size which is greater than the cross section of the string lengths.

2. A ball-game racket according to claim 1, wherein the cross section of the sleeve openings widens in trumpet or cone shape towards the inside of the frame.

3. A ball-game racket according to claim 1, wherein the sleeve openings have an oval cross section.

4. A ball-game racket according to claim 1, wherein the holes in the racket frame which receive the sleeves have on the frame inner side an oval cross section, the longer cross sectional axis of which lies in an axial direction perpendicular to the stringing plane.

5. A ball-game racket according to claim 4, wherein said sleeves have an oval outer cross section.

6. A ball-game racket according to claim 4, wherein the holes on the racket frame outer side have an oval cross section, the longer cross sectional axis of which lies in an axial direction perpendicular to the stringing plane.

7. A ball-game racket according to claim 6, wherein the sleeve has an oval outer cross section.

8. A ball-game racket according to claim 1, wherein said openings in said frame for receiving said sleeves have a cross-section at the outer side of the racket frame that is smaller than the cross section of said opening on the inner side of the racket frame.

9. A ball-game racket according to claim 1, wherein for at least some of the sleeves, the corresponding opening in the region not taken up by the corresponding string length is provided with a damping material of relatively permanent elasticity.

10. A ball-game racket according to claim 9, wherein the opening in the region thereof not taken up by the corresponding string length is completely taken up by the damping material.

11. A ball-game racket according to claim 9, wherein the damping material is substantially softer than or is of substantially less hardness than the material of the corresponding sleeve.

12. A ball-game racket according to claim 9, wherein the damping material is plastic.

13. A ball-game racket according to claim 9, wherein the damping material is introduced into the openings of the sleeves after the stringing of the racket head.

* * * * *